US006841790B1

(12) United States Patent
Phillips et al.

(10) Patent No.: US 6,841,790 B1
(45) Date of Patent: Jan. 11, 2005

(54) SNAP-IN RADIO FREQUENCY SCREEN FOR ULTRAVIOLET LAMP SYSTEM

(75) Inventors: John Thomas Phillips, Frederick, MD (US); Jeffrey Scott Mobley, Rockville, MD (US); Derek Steven Matheson, Gaithersburg, MD (US)

(73) Assignee: Miltec Corporation, Stevensville, MD (US)

( * ) Notice: Subject to any disclaimer, the term of this patent is extended or adjusted under 35 U.S.C. 154(b) by 0 days.

(21) Appl. No.: 10/680,689

(22) Filed: Oct. 7, 2003

(51) Int. Cl.[7] ..... G21G 4/00; H05B 41/16; A44B 21/00

(52) U.S. Cl. ..... 250/504 R; 250/492.1; 250/492.2; 250/493.1; 250/494.1

(58) Field of Search ..... 250/504 R, 493.1, 250/494.1, 492.1, 492.2

(56) References Cited

U.S. PATENT DOCUMENTS

| | | | | | |
|---|---|---|---|---|---|
| 3,911,318 | A | * | 10/1975 | Spero et al. | 315/39 |
| 4,041,352 | A | * | 8/1977 | McNeill et al. | 315/248 |
| 4,107,770 | A | * | 8/1978 | Weber | 362/405 |
| 4,247,737 | A | * | 1/1981 | Johnson et al. | 174/35 MS |
| 4,359,668 | A | * | 11/1982 | Ury | 315/39 |
| 4,485,332 | A | * | 11/1984 | Ury et al. | 315/112 |
| 4,535,565 | A | * | 8/1985 | Erickson | 49/493.1 |
| 4,641,033 | A | * | 2/1987 | Petelin et al. | 250/492.1 |
| 4,837,669 | A | * | 6/1989 | Tharp et al. | 362/418 |
| 5,004,425 | A | * | 4/1991 | Hee | 439/37 |
| 5,132,884 | A | * | 7/1992 | Totten | 362/147 |
| 5,191,460 | A | * | 3/1993 | Lapatovich | 398/201 |
| 5,228,891 | A | * | 7/1993 | Adiletta | 55/484 |
| 5,232,383 | A | * | 8/1993 | Barnick | 439/859 |
| 5,440,137 | A | * | 8/1995 | Sowers | 250/504 R |
| 5,556,566 | A | * | 9/1996 | Cappello et al. | 219/683 |
| 5,596,792 | A | * | 1/1997 | Shelton | 24/336 |
| 5,620,369 | A | * | 4/1997 | Spransy et al. | 454/187 |
| 5,743,754 | A | * | 4/1998 | Cristich | 439/349 |
| 6,231,209 | B1 | * | 5/2001 | Leibig et al. | 362/219 |
| 6,323,601 | B1 | * | 11/2001 | Klein et al. | 315/248 |
| 6,355,878 | B1 | * | 3/2002 | Kim | 174/35 GC |
| 6,439,736 | B1 | * | 8/2002 | Fiene | 362/147 |
| 6,483,023 | B1 | * | 11/2002 | Jacques | 174/35 GC |
| 2003/0099107 | A1 | * | 5/2003 | Hess | 362/290 |

* cited by examiner

*Primary Examiner*—John R. Lee
*Assistant Examiner*—Bernard E. Souw
(74) *Attorney, Agent, or Firm*—Dority & Manning, P.A.

(57) ABSTRACT

A UV lamp system and a reflector and RF screen assembly are provided. The UV lamp system includes a power supply and an irradiator that is powered by the power supply through a cable. An RF screen is releasably attached to the irradiator by a snap-fit fit connection. The snap-fit connection between the RF screen and the irradiator is provided by a snap-fit fastener. The reflector and RF screen assembly includes a reflector with a curved reflecting surface and a pair of flanges. An RF screen that has a screen retained by a frame is provided, and is releasably attached to the reflector by a snap-fit connection between the frame and the pair of flanges. At least one snap-fit fastener is used to effect releasable attachment between the frame and one of the flanges, and at least one snap-fit fastener is used to effect releasable attachment between the frame and the other one of the flanges.

22 Claims, 9 Drawing Sheets

SNAP-IN RADIO FREQUENCY SCREEN FOR ULTRAVIOLET LAMP SYSTEM

BACKGROUND

Ultraviolet (UV) lamp systems may be either microwave power UV lamp systems or medium pressure mercury vapor "ARC" lamp systems. UV lamp systems are used in high speed manufacturing processes to cure inks, coatings, and adhesives in a variety of applications. These applications may include, for instance, decorating, laminating, hard-coat protection, circuit board conformal coatings, and printing. UV lamp systems are also used to manufacture silicon semi-conductor wafers. Additionally, UV lamp systems may also be used for exposing imaging printing plate templates.

The typical UV lamp system includes an irradiator to produce high intensity UV light, a power supply to provide electrical power to the irradiator, and an interconnecting high voltage cable. The microwave power UV lamp system has an irradiator that is equipped with one or more magnetrons. The magnetrons convert the electrical power received from the power supply to Radio Frequency (RF) energy at approximately 2450 MHz. The microwave energy produced by the magnetrons in the irradiator is guided into a cavity which is captivated by an RF screen. An electrodeless medium pressure mercury-vapor lamp (or bulb) is positioned inside of this cavity. For UV curing applications, the bulb is typically formed in the shape of a tube with a slight "hour-glass" shape, and is constructed of quartz. For imaging and semi-conductor applications the bulb is typically spherical. The bulb may be filled with mercury, argon, and/or metal halides such as iron and gallium. The fill inside of the bulbs may absorb the microwave (RF) energy and, consequently, change to a plasma state. The plasma produces radiation energy in the UV lamp system which is the form of UV, visible, and infrared energy.

The UV lamp system is provided with an RF screen in order to captivate and seal the RF energy within the cavity where the electrodeless bulb is positioned in the irradiator. A conventional RF screen 10 is shown in FIG. 1. The RF screen 10 is composed of a metal frame 18 with a fine mesh screen 12, usually made of tungsten, retained thereon. As can be seen in FIG. 2, a metallic wire-woven mesh gasket 14 may be employed in order to provide a seal between a main reflector and end reflectors of the UV lamp system, and between the main reflector of the UV lamp system and the metal frame 18 of the RF screen 10. The gasket 14 is compressed between the metal frame 18 and a reflector when the RF screen 10 is attached.

The RF screen 10 prevents RF energy from escaping into the surrounding environment, and subsequently allows the bulb of the UV lamp system to light. A defective RF screen 10, such as one with a hole or other defect, would allow RF energy to escape and prevent the bulb of the UV lamp system from lighting, or cause a reduced output in the bulb of the UV lamp system. Additionally, an improperly installed RF screen 10 will cause arcing, and thus damage to components inside of the irradiator. Further, an RF screen 10 with deformed or worn gaskets 14 will also cause arcing and damage to the irradiator.

The RF screen 10 is attached to a reflector which helps define the cavity in the UV lamp system. FIG. 3 shows a conventional reflector 32 used in current UV lamp systems. The reflector 32 is provided with a plurality of holes 68 through which screws may be inserted so as to connect the RF screen 10 to the reflector 32. Referring to FIGS. 1 and 2, the screws may be disposed through holes 16. The use of screws is problematic in that they may be lost when the RF screen 10 is removed. If lost, the screws may not be replaced by the user of the UV lamp system, resulting in improper and non-uniform pressure on the metallic wire-woven mesh gasket 14. This in turn could cause arcing between the RF screen 10 and the reflector, resulting in damage to components of the UV lamp system such as the RF screen 10, reflector, magnetrons, metallic wire-woven mesh gasket 14, and the bulb. Arcing may also reduce the coupling efficiency of the RF energy to the bulb, thus reducing the bulb's output.

Additionally, screws may be stripped during removal or insertion, resulting in improper torque on the screws, and thus improper tightening of the RF screen 10. This in turn may create gaps between the reflector and the metal frame 18 of the RF screen 10, causing arcing in certain areas. Screw threads may also be stripped when inserting the screw at an improper angle. This may cause damage to the female threads in the reflector to which the RF screen 10 is attached, possibly resulting in a need to replace the entire reflector assembly. Over-torqueing of the screws may create too much pressure causing a permanent deformation of the metallic wire-woven mesh gasket 14 and will in turn cause gaps if the RF screen 10 is removed and replaced without the same amount of torque on the screws. If the screws are not properly tightened, gaps or insufficient surface contact with the metallic wire-woven mesh gasket 14 may result to also cause arcing.

UV lamp systems that employ screws to attach the RF screen 10 require the removal of 4 screws for a 6-inch irradiator, and 8 screws for a 10-inch irradiator. Removing and replacing these screws during removal/replacement of the RF screen 10 is a very tedious and time-consuming process, especially when the UV lamp system employs many irradiators. This results in increased maintenance time, and leads to more machine downtime for the UV lamp system.

The present invention improves upon current UV lamp systems by providing for an improved attachment of the RF screen 10. As a result, the amount of damage to the UV lamp system is reduced, the efficiency of the UV lamp system is improved, and the amount of downtime to the UV lamp system is reduced.

SUMMARY

Various features and advantages of the invention will be set forth in part in the following description, or may be obvious from the description.

The present invention provides for a UV lamp system that has a power supply and an irradiator powered by the power supply and connected thereto by a cable. An RF screen is releasably attached to the irradiator by a snap-fit connection. A snap-fit fastener is employed in order to provide the snap-fit connection between the RF screen and the irradiator.

The present invention also provides for a reflector and an RF screen assembly for a UV lamp system. This assembly includes a reflector that has a curved reflecting surface and a pair of flanges and an RF screen retained by a frame. The RF screen is releasably attached to the reflector by a snap-fit connection between the frame and the pair of flanges of the reflector. Also, at least one snap-fit fastener is used to provide the releasable attachment between the frame of the RF screen and one of the flanges of the reflector.

The present invention also provides for a UV lamp system and a reflector and RF screen assembly as discussed above where the snap-fit fastener is a ball stud fastener. The ball stud fastener includes a ball stud that is located on either the RF screen or the irradiator/reflector. Additionally, a spring latch is located on the other one of the RF screen or irradiator/reflector, which does not have the ball stud. The ball stud is releasably engageable with the spring latch in order to effect the snap-fit connection. Also, other exemplary embodiments exist in which both spring latches and ball studs are present on one element and engage complimentary balls studs and spring latches on the other element.

The present invention also provides for a UV lamp system and a reflector and RF screen assembly as discussed above where the snap-fit fastener is a spring retainer. The spring retainer includes a spring clip that is located on either the RF screen or the irradiator/reflector. A notch is present on the other one of the RF screen or irradiator/reflector which does not include the spring clip. The spring clip is releasably engageable with the notch in order to effect the snap-fit connection. Also, other exemplary embodiments exist in which both spring clips and notches are present on one element and engage complimentary spring clips and notches on the other element.

The present invention also provides for a UV lamp system and a reflector and RF screen assembly as discussed above where the snap-fit fastener may be either a magnetic fastener or a quarter-turn type fastener.

Also provided for in accordance with the present invention is a UV lamp system and a reflector and RF screen assembly as discussed above which further has a gasket disposed between the RF screen and the irradiator/reflector. In certain exemplary embodiments of the present invention, the gasket may be a metallic finger gasket, or may be a woven metallic wire mesh gasket, or may be a metal fabric wrapped around an elastomer sponge core center gasket.

The present invention also provides for a reflector and RF screen assembly for use with a UV lamp system that includes: a reflector with a curved reflecting surface and a pair of flanges, a spring latch, an RF screen with a frame and a fine mesh screen, a ball stud, and a metal fabric wrapped around an elastomeric sponge core center gasket.

DETAILED DESCRIPTION OF PREFERRED EMBODIMENTS

Figure 1:
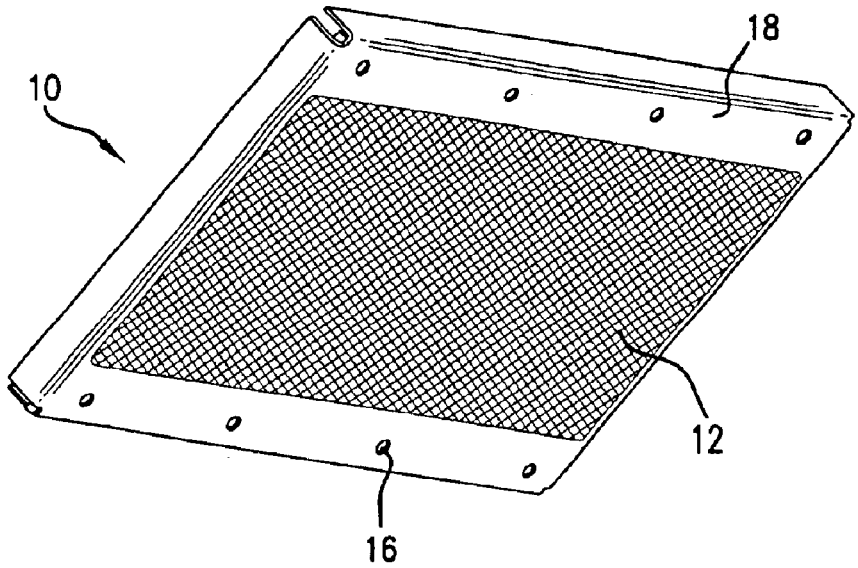
FIG.1 PRIOR ART
FIG. 1 is a bottom perspective view of a conventional RF screen.
Figure 2:
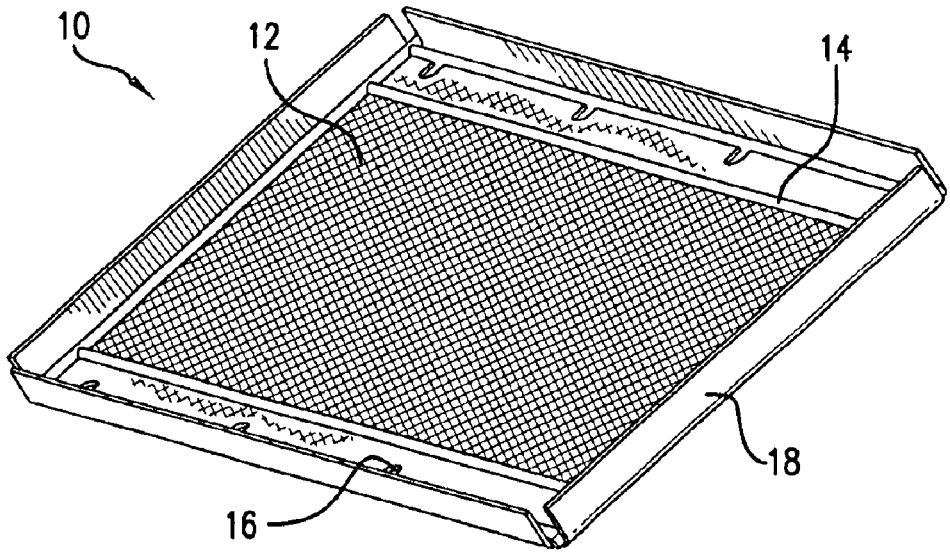
FIG.2 PRIOR ART
FIG. 2 is a top perspective view of the RF screen shown in FIG. 1.
Figure 3:
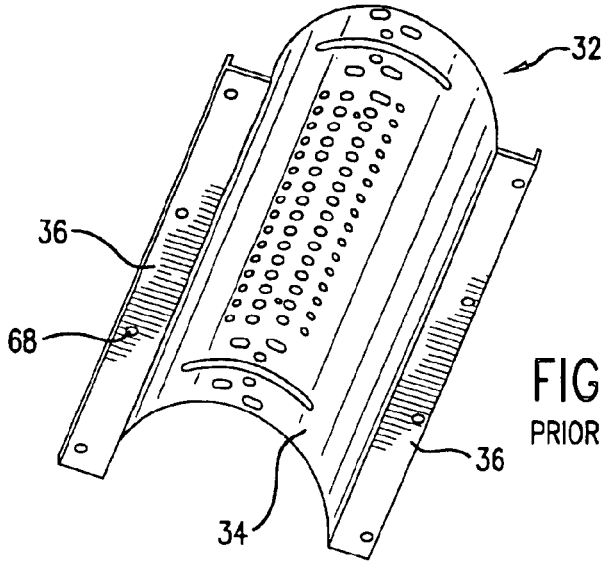
FIG.3 PRIOR ART
FIG. 3 is a bottom perspective view of a conventional reflector having a plurality of holes disposed thereon for attachment with the RF screen of FIGS. 1 and 2.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modification and variations.

Figure 4:
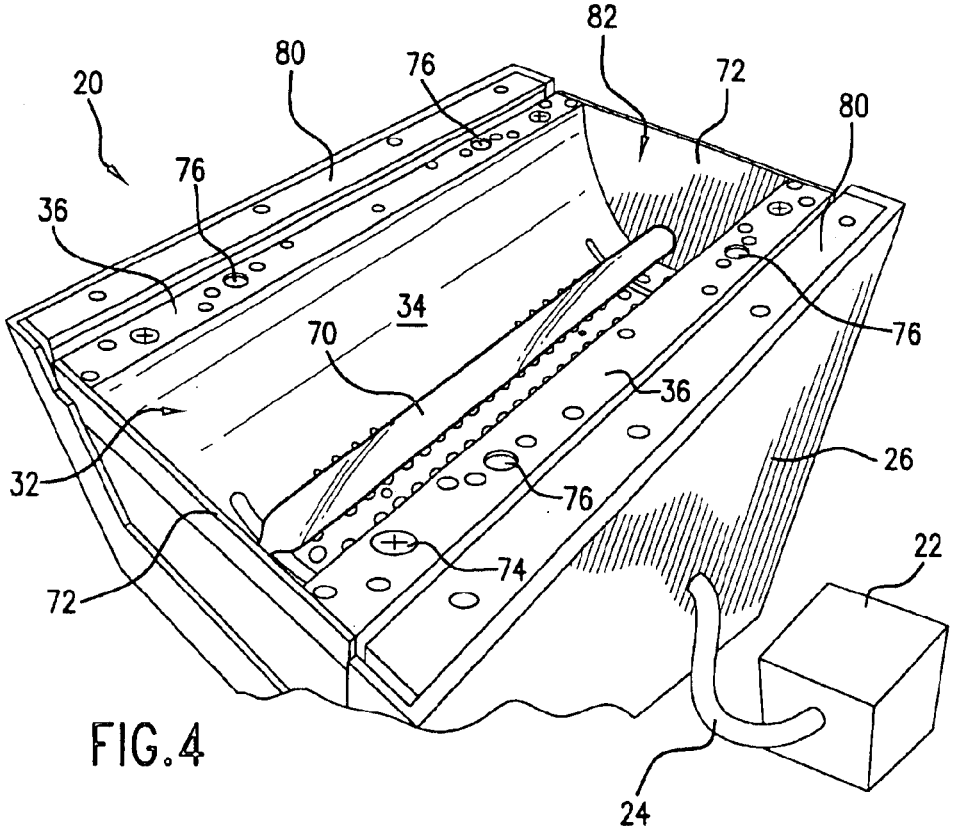
FIG. 4 is a perspective view of a UV lamp system used in accordance with one exemplary embodiment of the present invention. The UV lamp system has the RF screen removed.

A UV lamp system, generally 20, used in accordance with one exemplary embodiment of the present invention is shown in FIG. 4. The UV lamp system 20 includes a power supply 22 (not to scale) connected to an irradiator 26 through a cable 24. Irradiator 26 produces high intensity UV light for the curing of objects. Irradiator 26 may include a reflector 32 that is attached thereon by one or more bolts 74. Reflector 32 may include a curved reflecting surface 34 in order to properly focus UV light energy emitted from a bulb 70 contained within reflector 32. A pair of end reflectors 72 may also be included in irradiator 26 in order to further contain the RF energy and focus UV energy produced by bulb 70. In certain exemplary embodiments of the present invention, reflector 32 may include both curved reflecting surface 34 and end reflectors 72. The curved reflecting surface 34 may be either elliptical, spherical, or of other configurations commonly known in the art in accordance with various exemplary embodiments of the present invention.

Figure 5:
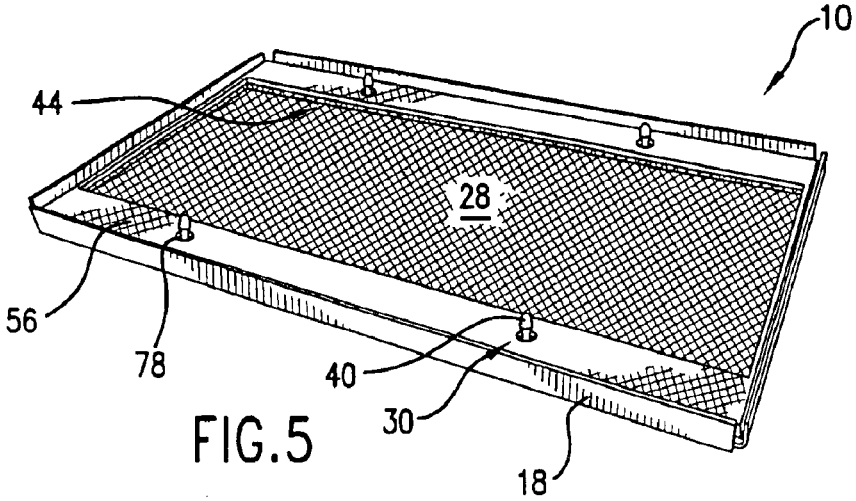
FIG. 5 is a perspective view of an exemplary embodiment of an RF screen in accordance with one exemplary embodiment of the present invention. The RF screen is fitted with snap-fit fasteners that include ball studs.
Figure 6:
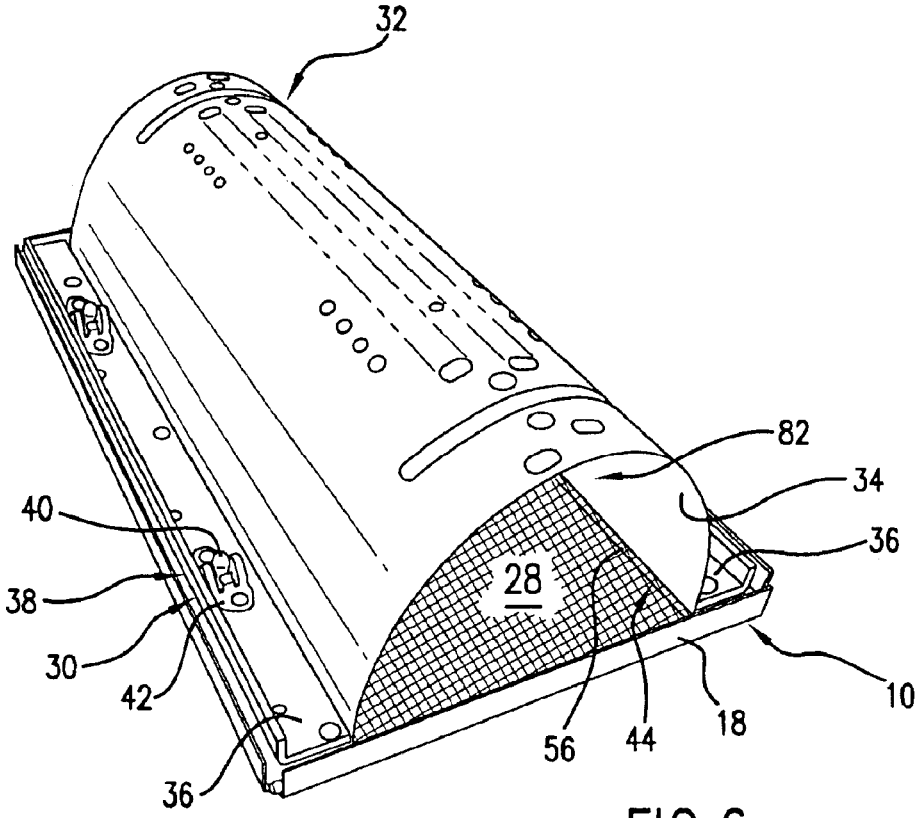
FIG. 6 is a perspective view of the RF screen of FIG. 5 attached to a reflector by use of a snap-fit fastener that is a ball stud fastener formed by a ball stud and a spring latch.

Referring now to both FIGS. 5 and 6, an RF screen 10 may be employed in order to captivate and seal RF energy within a cavity 82 in which bulb 70 (FIG. 4) is positioned and is defined by curved reflecting surface 34, end reflectors 72 (FIG. 4), and the RF screen 10. In certain exemplary embodiments of the present invention, the cavity 82 may be defined by only RF screen 10 and reflector 32.

FIG. 5 shows RF screen 10 having a gasket 44, disposed thereon. Gasket 44 may be used to create a seal via continuous metal-to-metal contact between curved reflecting surface 34 and the end reflectors 72 (FIG. 4), and curved reflecting surface 34 and metal frame 18 of RF screen 10. Without such a seal, RF energy may escape into the surrounding environment and prevent bulb 70 (FIG. 4) from lighting. In accordance with one exemplary embodiment of the present invention, gasket 44 may be a metal fabric wrapped around an elastomer sponge core center gasket 56. The shape of the gasket 44 can vary depending upon the shape of other components in the UV lamp system 20, and as such can be constructed in any shape or size in order to effect a proper seal.

Figure 8B:
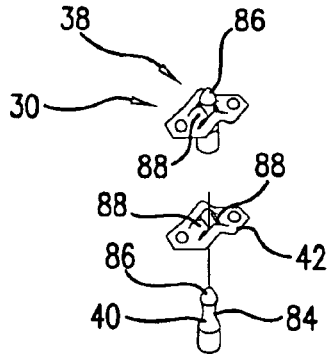
FIG. 8B is a perspective view of a ball stud fastener formed by a ball stud and a spring latch in accordance with one exemplary embodiment of the present invention.

The exemplary embodiment of RF screen 10 shown in FIG. 5 has a snap-fit fastener 30 which allows for RF screen 10 to be releasably attached to reflector 32 (FIG. 6). In this exemplary embodiment, the snap-fit fastener 30 is a ball stud fastener 38 made up of one or more ball studs 40 and spring latches 42 as shown in FIG. 8B. The ball studs 40 include a ball portion 86 located on one end and adjacent to a recessed portion 84. The spring latches 42 include a pair of springs 88. Urging of the ball portion 86 causes the springs 88 to be pushed out of the way, and allows the recessed portion 84 to be positioned next to where the springs 88 were originally located. Once the ball portion 86 is urged past the springs 88, the springs 88 bounce back into position and contact the recess portion 84, effecting a locking of the ball stud 40 and the spring latch 42. Pulling the ball stud 40 such that the springs 88 are forced away from the recess portion 84 and the ball portion 86 may disengage these two components.

Referring now to FIG. 5, four ball studs 40 are attached to metal frame 18 of RF screen 10. However, it is to be understood that in accordance with other exemplary embodiments of the present invention, more than or fewer than four ball studs 40 may be employed. A plurality of holes 78 may be disposed in gasket 44 such that ball studs 40 may be attached to metal frame 18 and be disposed through gasket 44.

FIG. 6 shows the ball stud fastener 38 in engagement with the spring latch 42. Spring latch 42 is attached to a flange 36 of reflector 32. Ball stud 40 may engage spring latch 42 and compresses spring latch 42, eventually being locked into place. As shown in the exemplary embodiment of FIG. 6, four ball stud fasteners 38 are employed, two being on one of flanges 36, and two being employed on the other flange 36. The embodiment shown in FIGS. 4–6 is the preferred embodiment of the present invention. As can be imagined, fewer than or more than four ball stud fasteners 38 may be employed in accordance with other exemplary embodiments of the present invention.

Snap-fit fastener 30 allows for RF screen 10 to be quickly and easily attached to reflector 32 by mating together ball studs 40 and spring latches 42. Upon application of a small amount of pressure to RF screen 10, ball studs 40 are "snapped" into place in their respective spring latch 42. Referring to FIG. 4, spring latches 42 (FIG. 6) may be located on the irradiator 26, or may be located on flange 36 of the reflector 32, or the screen 28. Here, a opening 76 may be defined by the flange 36 in order to allow ball stud 40 (FIG. 6) to engage spring latch 42 (FIG. 6). Although the exemplary embodiments shown in FIGS. 4–6 have spring latch 42 attached to reflector 32 and ball stud 40 attached to RF screen 10, other exemplary embodiments of the present invention exist in which ball studs 40 are attached to reflector 32 and/or irradiator 26, and spring latch 42 is attached to RF screen 10. It is to be understood that spring latches 44 and ball studs 40 may be on either or both of the irradiator 26 and/or the flanges 36 in accordance with other exemplary embodiments of the present invention.

Figure 7:
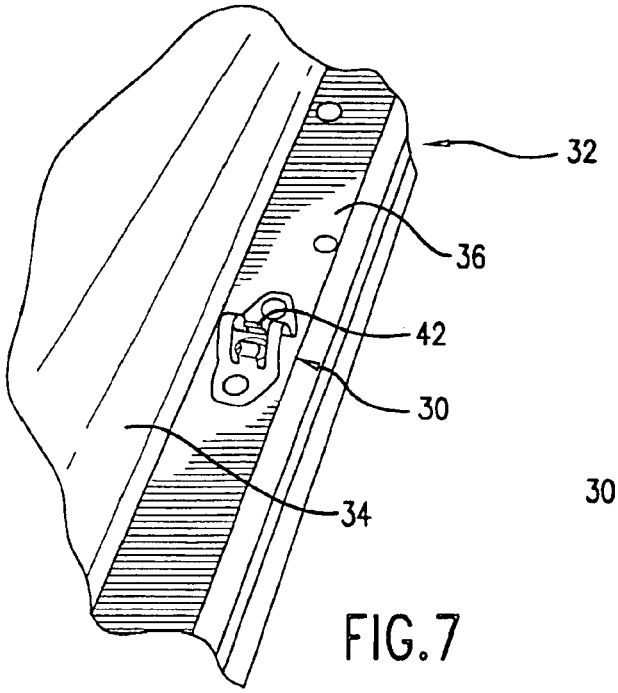
FIG. 7 is a close-up perspective view of a spring latch attached to a flange of a reflector in accordance with one exemplary embodiment of the present invention.

Ball stud fastener 38, composed of ball stud 40 and spring latch 42, is shown in greater-detail in FIG. 8B. Additionally, the configuration of spring latch 42 on flange 36 of reflector 32 is shown in greater detail in FIG. 7. Referring now to FIG. 8B, ball stud 40 and spring latch 42 may be selected and installed in order to provide sufficient pressure on gasket 44 in order to ensure adequate metal-to-metal contact and provide a sufficient RF seal in the UV lamp system 20 (FIG. 4). Additionally, sizing of these components may be done in order to allow RF screen 10 (FIG. 5) to snap into place with a minimum amount of force, but with enough hold strength to retain RF screen 10 (FIG. 5) in place during operation of UV lamp system 20 (FIG. 4). The sizing of these components may also be done in order to allow RF screen 10 (FIG. 5) to be removed with a small enough force so that one person may pull off RF screen 10 FIG. 5) with his or her hands without the use of any tools and without causing damage to RF screen 10 (FIG. 5) during removal.

Proper selection of ball studs 40 and spring latches 42 along with gasket 44 may allow RF screen 10 (FIG. 5) to function properly and reliably during operation of the UV lamp system 20 (FIG. 4) and several cycles of removing and reattaching RF screen 10 (FIG. 5) to and from reflector 32 (FIG. 6). Gasket 44 may be constructed of a conductive metallic material, and may be UV resistant, high temperature resistant, and have a relatively high compression ratio without exceeding its yield stress and to cause permanent deformation of gasket 44. A relatively high compression ratio of gasket 44 may enable the operator to snap on RF screen 10 (FIG. 5) with minimal force, while at the same time allowing for excellent continuous metal-to-metal contact between metal frame 18 (FIG. 5) and reflector 32 (FIG. 6). In certain exemplary embodiments of the present invention, gasket 44 may be both UV resistant and able to withstand temperatures up to 400° F.

Figure 8A:
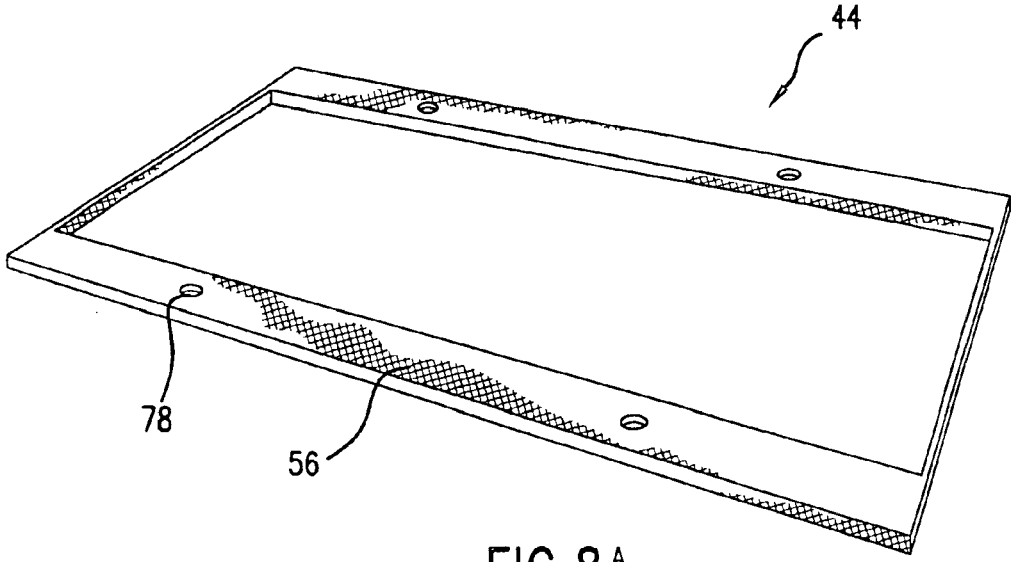
FIG. 8A is a perspective view of a gasket in accordance with one exemplary embodiment of the present invention.

The exemplary embodiment of gasket 44 shown in FIG. 8A is a metal fabric wrapped around an elastomer sponge core center gasket 56. This type of gasket 56 may be a single piece and may be customized to the exact geometry needed to complete an RF seal. As can be seen in FIG. 8A, gasket 56 may be configured in order to contact each of the flanges 36 (FIG. 4) of reflector 32 (FIG. 4) and each one of the end reflectors 72 (FIG. 4).

Figure 9:
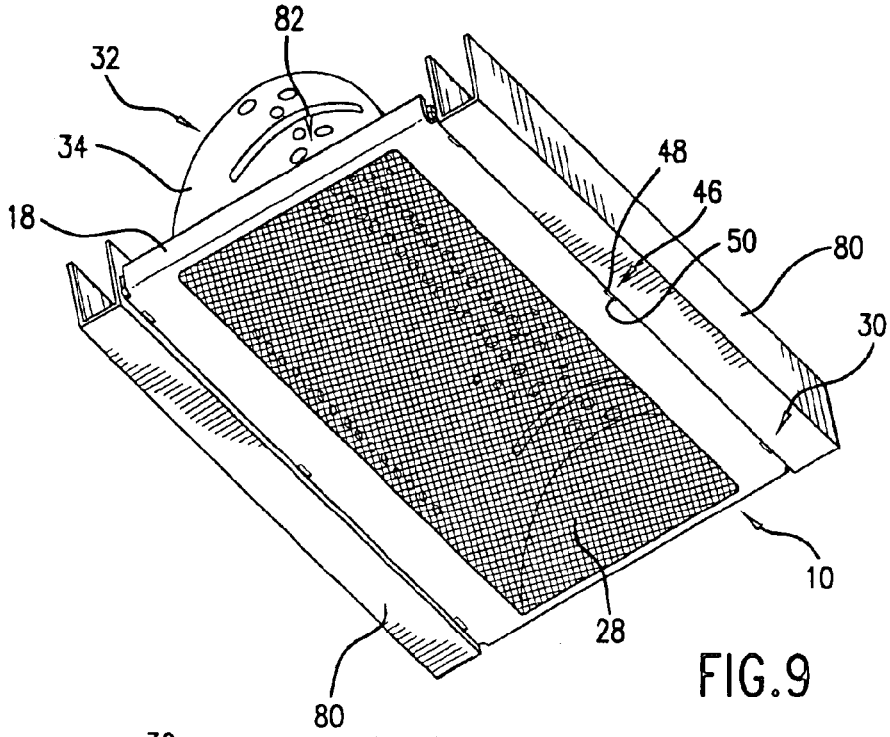
FIG. 9 is a perspective view of an RF screen releasably attached to a reflector in accordance with one exemplary embodiment of the present invention. Here, a snap-fit fastener that is a spring retainer is used to effect the releasable attachment.
Figure 10:
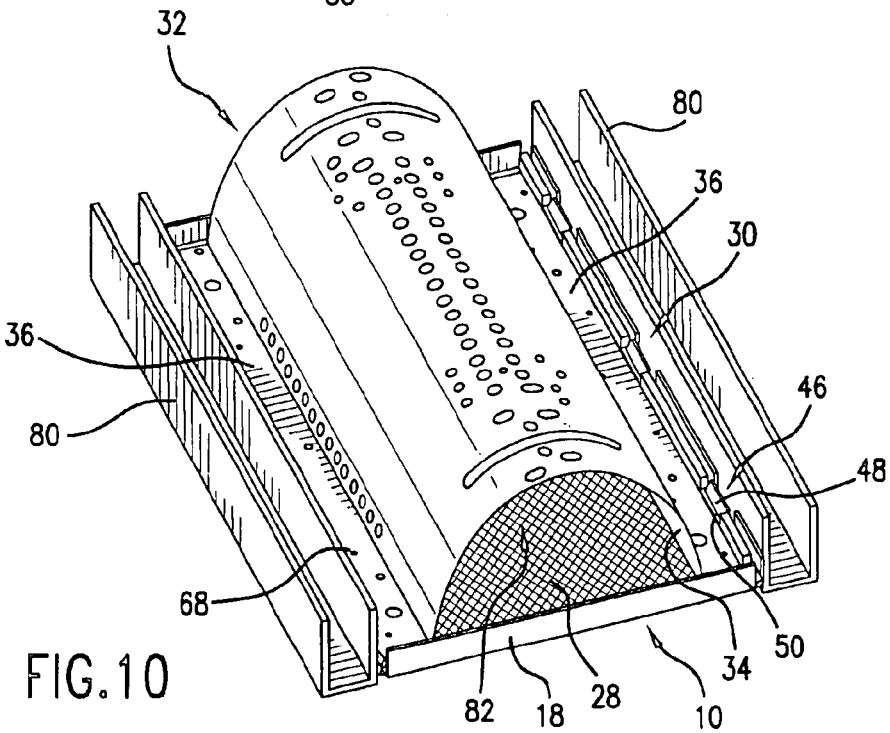
FIG. 10 is a top perspective view of the exemplary embodiment shown in FIG. 9. The spring retainer is shown being formed by a spring clip that engages a notch.
Figure 11:
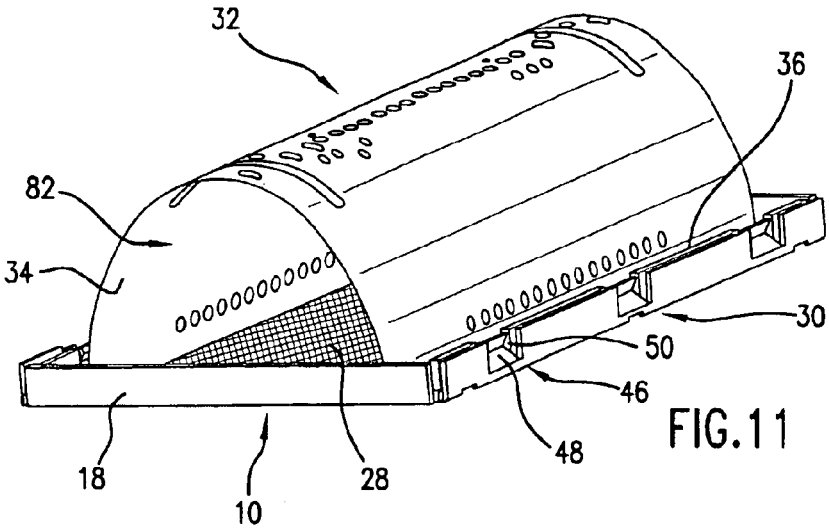
FIG. 11 is a perspective view of the RF screen and reflector of FIGS. 9 and 10, but with a pair of irradiator rails removed in order to more clearly show the spring retainer.

Another exemplary embodiment of the present invention is shown in FIG. 9 in which ball stud fastener 38 composed of ball stud 40 and spring latch 42 disclosed in FIGS. 4–8 are replaced by a snap-fit fastener 30 that is a spring retainer 46. Spring retainer 46 acts to retain RF screen 10 on reflector 32. Spring retainer 46 allows a user to attach and remove RF screen 10 from reflector 32 quickly and relatively effortlessly. Referring now to FIGS. 10 and 11 which show different views of reflector 32 and RF screen 10, spring retainer 46 may be made of a notch 50 in metal frame 18 of RF screen 10. Additionally, spring retainer 46 may be made of a spring clip 48 attached to metal frame 18 of RF screen 10. Spring clip 48 may be either formed directly into metal frame 18, or may be a separate component that is attached to metal frame 18 in accordance with various exemplary embodiments of the present invention. Spring clips 48 may be formed in a "V" shape or in a semicircular "C" shape.

Spring clip 48 may be compressed during engagement of metal frame 18, and then may snap into place upon engagement with notch 50. The angle and/or geometry of spring clip 48 may be designed in order to provide a sufficient amount of pull force on RF screen 10 such that RF screen 10 is urged against reflector 32, and gasket 44 (FIG. 8A) is adequately engaged and provides an effective RF seal of the RF energy in UV lamp system 20 (FIG. 4). As shown in FIGS. 9–11, three spring retainers 46 are located on one of the flanges 36, and three spring retainers 46 are located on the other flange 36. It is to be understood that in accordance with various exemplary embodiments of the present invention, more or fewer than six spring retainers 46 may be employed in order to adequately attach RF screen 10 to reflector 32. In addition to being "V" or "C" shaped, spring clip 48 may be of other configurations in accordance with other exemplary embodiments of the present invention. Additionally, spring clip 48 may be located on flange 36 as opposed to being located on metal frame 18 in accordance with other exemplary embodiments of the present invention. In this case, notch 50 will be located on metal frame 18 instead of flange 36. Additionally, notch 50 is not necessary in accordance with certain exemplary embodiments of the present invention. In this instance, spring clip 48 will engage flange 36 and retain RF screen 10 to reflector 32 through a compressive pulling force of spring clip 48 without the need for notch 50.

Additional exemplary embodiments of the present invention exists where combinations of different types of snap-fit fasteners 30 are employed. For instance, RF screen 10 may be attached to reflector 32 through the use of one or more ball stud fasteners 38 and one or more spring retainers 46.

Pulling the snap-fit fasteners 30 allows for faster and easier removal and reattachment of RF screen 10 to reflector 32. RF screen 10 may be removed by having a user pull metal frame 18 away from reflector 32 with either one or both hands. Doing so will disengage ball stud 40 from spring latch 42 and/or spring clip 48 from notch 50, depending on which type of snap-fit fastener 30 is employed. The ball portion 86 of the ball stud will be moved past the springs 88 of the spring latch 42, causing them to be removed from the recessed portion 84 and hence effect disengagement of the two components. Likewise when the spring retainer 46 is used, spring clip 48 will be urged away from the notch 50 due to resiliency in the spring clip 48, causing the spring clip 48 to be pushed out of engagement and effecting removal of the spring clip 48 from the notch 50. The attachment of RF screen 10 involves aligning ball stud 40 with the appropriate spring latch 42 and/or spring clip 48 with the appropriate notch 50 and applying a small amount of pressure by the user's hands to effect engagement of these components. Resiliency of the springs 88 and the spring clip 48 will allow for the ball stud 40 and the spring clip 48 to be snapped into engagement with either the ball stud fastener 38 or the spring retainer 46 depending upon which one is being employed.

Figure 12:
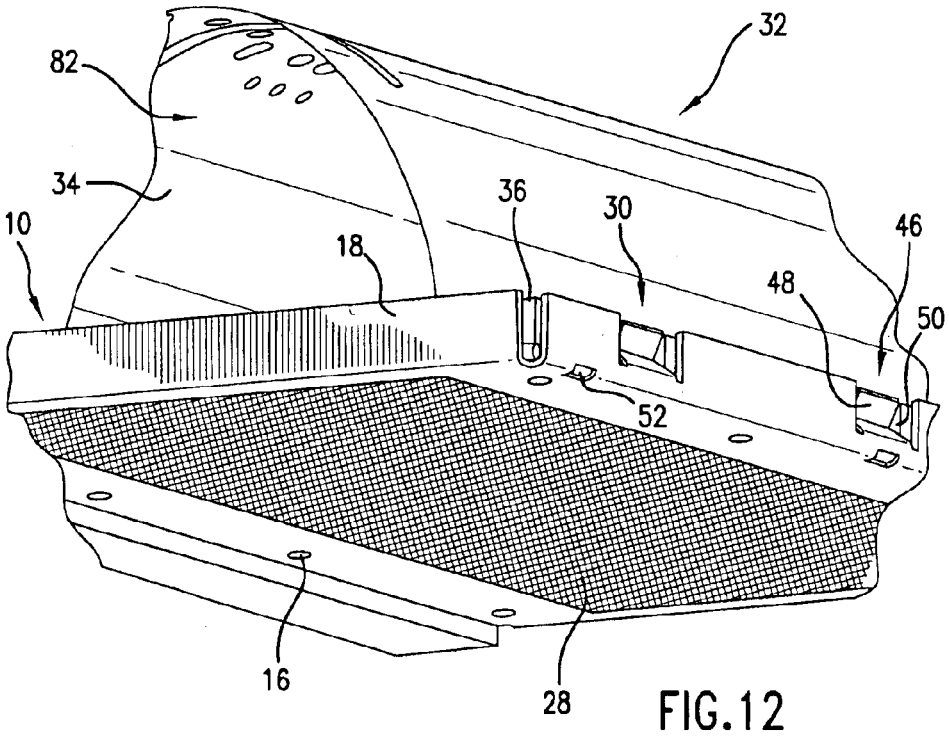
FIG. 12 is a perspective view of an RF screen releasably attached to a reflector in accordance with one exemplary embodiment of the present invention. The frame of the RF screen is provided with a plurality of slots in order to aid in the removal of the RF screen from the reflector.

FIG. 12 shows an exemplary embodiment of the present invention where metal frame 18 of RF screen 10 is provided with a slot 52. Slot 52 may be provided next to one of fasteners 30 in order to allow for the prying RF screen 10 from reflector 32 should a stronger attachment between these components be desired. A tool such as a flathead screwdriver may be inserted into slot 52 in order to effect removal of RF screen 10.

Gasket 44 may be made either entirely or partially of a material with high conductive properties. For example, gasket 44 may be made of monel, aluminum, copper, silver-plated copper, tin-plated copper, beryllium copper, and/or stainless steel. Gasket 44 may be constructed in order to have adequate yield/spring properties in order to allow gasket 44 to be compressed between RF screen 10 and reflector 32 to help create an RF seal, and also allow for gasket 44 to spring back to its original profile. The metal fabric wrapped around an elastomer sponge core center gasket 56 may be used in certain exemplary embodiments of the present invention as an improvement to conventional wire mesh gaskets 44 because the metal fabric wrapped around an elastomer sponge core center gasket 56 exhibits greater compressibility and a higher yield value when not being permanently deformed. Further, it is to be understood than in other exemplary embodiments of the present invention, gasket 44 used may be a conventional wire mesh gasket.

Figure 13:
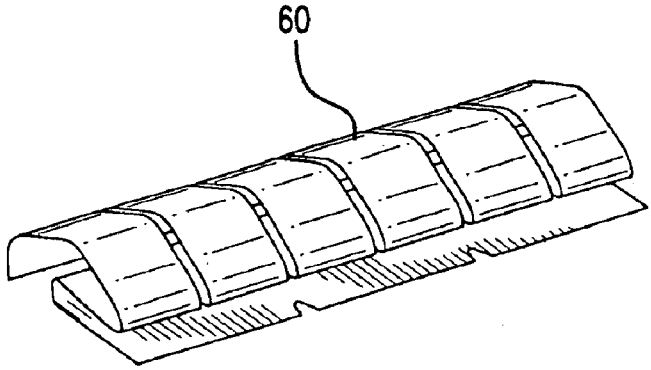
FIG. 13 is a perspective view of an exemplary embodiment of one configuration of metallic finger gasket used in accordance with the present invention.
Figure 14:
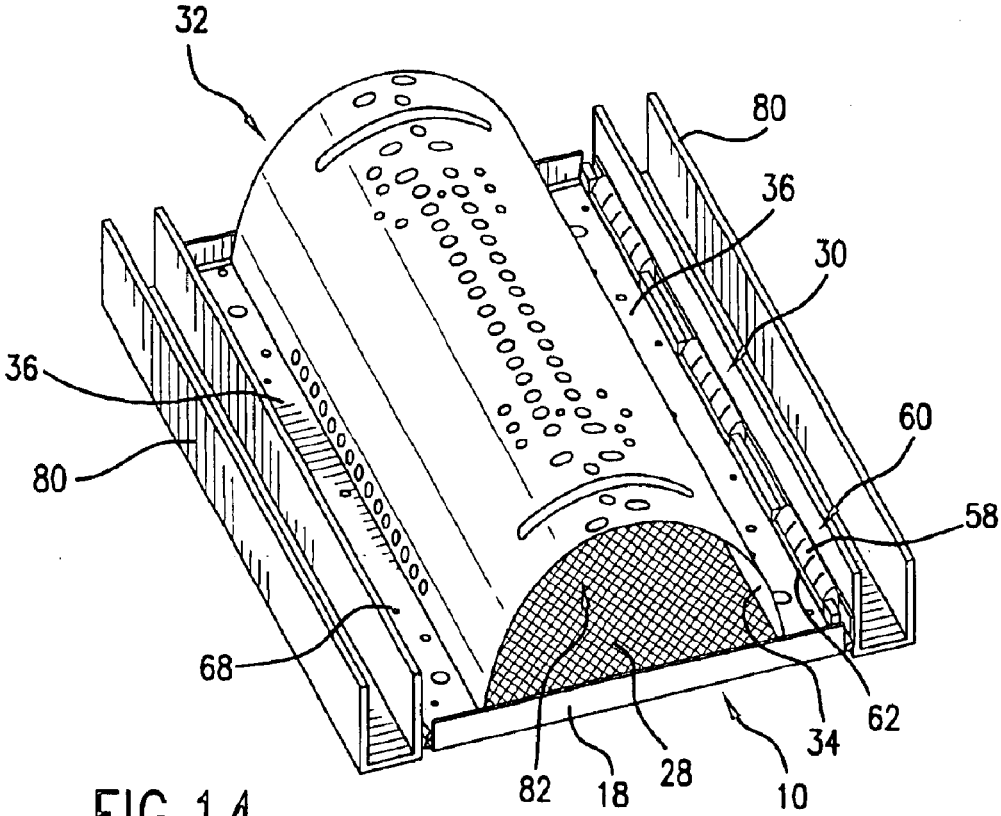
FIG. 14 is a perspective view of an RF screen releasably attached to a reflector in accordance with one exemplary embodiment of the present invention. The finger gasket of FIG. 13 is used to effect the releasable attachment.

FIG. 13 shows a metallic finger gasket 60 that may be used in accordance with one exemplary embodiment of the present invention. Metallic finger gasket 60 in combination with a notch 62 forms a finger gasket assembly 58 as shown in FIG. 14. Finger gasket assembly 58 is used to retain RF screen 10 onto reflector 32 in much the same way as ball stud fastener 38 of FIG. 6, and the spring retainer 4–6 of FIG. 10. Metallic finger gasket 60 may be attached to metal frame 18 of RF screen 10 by welding, brazing, riveting, screwing, adhesives, or by any other method commonly known to those skilled in the art. The shape of metallic finger gasket 60 may be similar in shape and operation to spring clip 48. Any shape is suitable which exhibits a lateral component of force in order to effect engagement. For instance metallic finger gasket 60 may be of a "C" shape or of a "V" shape or any other shape the metallic finger gasket 60 may operate in the same way as the spring clip 48 as described above.

Metallic finger gasket 60 may be inserted into notch 62 upon the application of pressure to RF screen 10 by a user, and may be removed from notch 62 upon being pulled by a user as previously discussed with respect to other exemplary embodiments. In other exemplary embodiments of the present invention, notch 62 is not needed or used in order for metallic finger gasket 60 to retain RF screen 10. In this case, the metallic finger gasket 60 (or the spring clip 48 as described above in regards to other exemplary embodiments) may rely on the strength of its spring force in engaging a surface alone, without the need to be inserted and retained in notch 62. In addition to retaining RF screen 10 on reflector 32, metallic finger gasket 60 may also provide an RF seal of cavity 82. By configuring metallic finger gasket 60 to provide an RF seal, the need for a gasket 44 would be eliminated, and hence metallic finger gasket 60 may provide both the function of retaining the RF screen 10 to reflector 32 and providing an RF seal of cavity 82. Alternatively, a gasket 44 may be used in combination with metallic finger gasket 60 in order to provide a more secure RF seal. In order to provide the RF seal, in certain exemplary embodiments, metallic finger gasket 60 could be mounted around the entire inside edge of metal frame 18 of RF screen 10.

Figure 15:
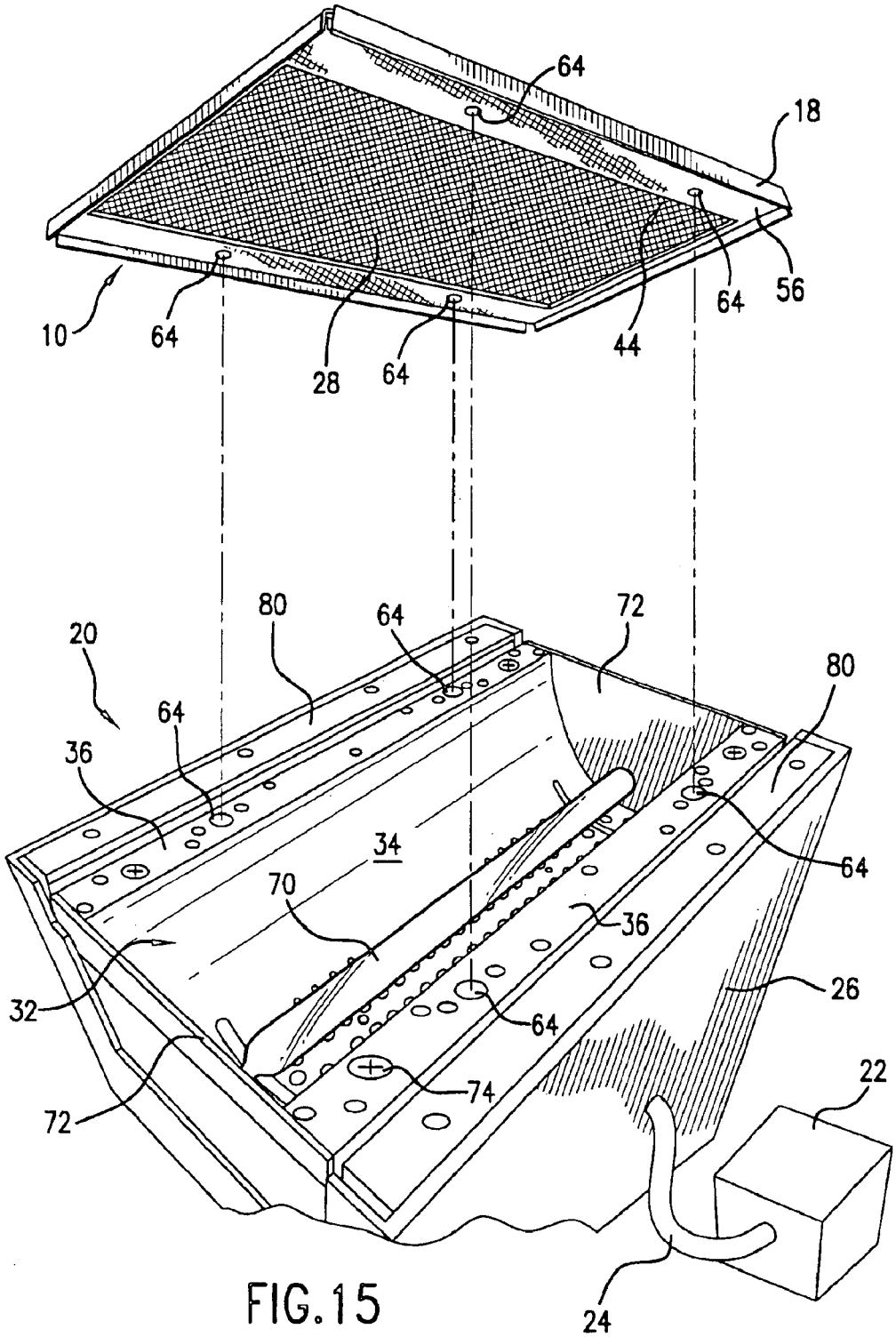
FIG. 15 is a perspective/partially exploded view of a UV lamp system in accordance with one exemplary embodiment of the present invention. Releasable attachment between the RF screen and the reflector/irradiator is effected by a snap-fit fastener that is a magnetic fastener.

The present invention also provides for exemplary embodiments where snap-fit fastener 30 may be variously configured in order to provide for an attachment of RF screen 10 to reflector 32. FIG. 15 shows an alternative exemplary embodiment of UV lamp system 20 where snap-fit fastener 30 is a magnetic fastener 64. Magnetic fastener 64 may be attached to metal frame 18 of RF screen 10 and flanges 36 of reflector 32 and/or irradiator rail 80. This attachment may be made by any means commonly known in the art, for instance welding, brazing, riveting, screwing, adhesives, or other methods may be employed. RF screen 10 may be attached to reflector 32 upon simply positioning magnetic fastener 64 such that a magnetic force is created to hold these components together. Magnetic fastener 64 may be selected of such a strength such that a sufficient hold and RF seal are provided, yet the magnetic force is weak enough to allow a user to remove RF screen 10 from the reflector 32. The magnetic fastener 64 can be located along the entire length of flange 36 and/or irradiator rail 80 and metal frame 18, or can be located only at various points thereon. Additionally, any number of magnetic fasteners 64 may be employed in accordance with various exemplary embodiments of the present invention.

Figure 16:
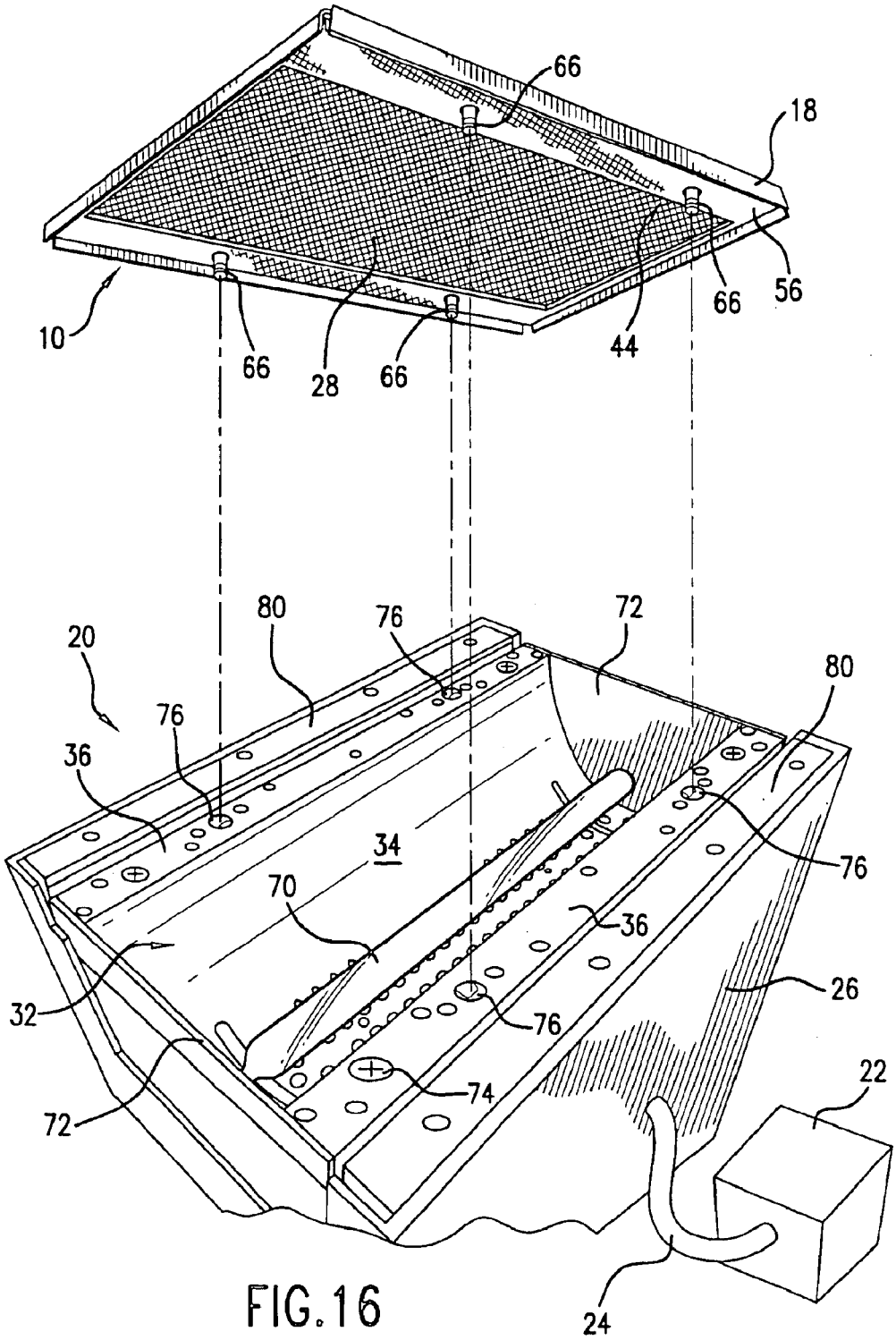
FIG. 16 is a perspective/partially exploded view of a UV lamp system in accordance with one exemplary embodiment of the present invention. The releasable attachment between the RF screen and the reflector/irradiator is provided by a snap-fit fastener that is a quarter-turn type fastener.

FIG. 16 shows another exemplary embodiment of the present invention where snap-fit fastener 30 is a quarter-turn type fastener 66. In order to engage quarter-turn type fastener 66, the user will turn quarter-turn type fastener 66 a small amount, generally a quarter of a revolution. This turning may be made either by the hand of the user, or may be made by a tool such as a screwdriver. Although the quarter-turn type fastener 66 may not be as fast as previous exemplary embodiments of snap-fit fastener 30, quarter-turn type fastener 66 is still an improvement over conventional screws which must be rotated multiple times by a user in order to effect engagement.

The present invention therefore provides for various exemplary embodiments of snap-fit fastener 30. Additionally, the present invention is not limited to the use of a single type of snap-fit fastener 30, but instead the UV lamp system 20 may be configured in order to incorporate one or more different types of snap-fit fastener 30 therein. Additionally, various types of gaskets 44 may be used in accordance with the present invention, and the present invention is not limited to simply employing one single type of gasket 44 therein. Also, although being described as releasably attached to reflector 32, RF screen 10 may be releasably attached to other components of UV lamp system 20 in accordance with other exemplary embodiments of the present invention. For instance, RF screen 10 may be releasably attached to irradiator rails 80 of UV lamp system 20 or other components.

It should be understood that the present invention includes various modifications that can be made to the embodiments of UV lamp system 20, along with reflector 32 and RF screen 10 described herein has come within the scope of the appended claims and their equivalents.

What is claimed:

1. A UV lamp system, comprising:

a power supply;

a cable connected to the power supply;

an irradiator connected to the cable and powered by the power supply;

an RF screen releasably attached to the irradiator by a snap-fit connection; and a snap-fit fastener assembly used to effect the snap-fit connection between the RF screen and the irradiator, wherein a portion of the snap-fit fastener assembly is attached to the RF screen and a complimentary portion of the snap-fit fastener assembly is attached to the irradiator.

2. The UV lamp system of claim 1, wherein the irradiator has a reflector with a curved reflecting surface and a pair of flanges, and wherein the RF screen is releasably attached to the pair of flanges of the irradiator by the snap-fit fastener.

3. The UV lamp system of claim 1, wherein the snap-fit fastener is a ball stud fastener having a ball stud located on one of the RF screen or irradiator, and having a spring latch located on the other of the RF screen or irradiator, the ball stud releasably engageable with the spring latch in order to effect the snap-fit connection.

4. The UV lamp system of claim 1, further comprising a gasket disposed between the RF screen and the irradiator.

5. The UV lamp system of claim 1, wherein the snap-fit fastener is a spring retainer having a spring clip located on one of the RF screen or irradiator, and having a notch present in the other of the RF screen or irradiator, the spring clip releasably engageable with the notch in order to effect the snap-fit connection.

6. The UV lamp system of claim 1, wherein the RF screen has at least one slot located thereon for aiding in the removal of the RF screen from the irradiator.

7. The UV lamp system of claim 4, wherein the gasket is selected from the group consisting of a metallic finger gasket, and a metal fabric wrapped around an elastomer sponge core center gasket.

8. The UV lamp system of claim 1, wherein the snap-fit fastener is a finger gasket assembly having a metallic finger gasket located on one of the RF screen or the irradiator, and having a notch present in the other of the RF screen or the irradiator, the metallic finger gasket releasably engageable with the notch in order to effect the snap-fit connection, and the finger gasket assembly aiding in sealing of the irradiator.

9. The UV lamp system of claim 1, wherein the snap-fit fastener is a magnetic fastener.

10. The UV lamp system of claim 1, wherein the snap-fit fastener is a quarter-turn type fastener.

11. A reflector and RF screen assembly for a UV lamp system, comprising:

a reflector having a curved reflecting surface and a pair of flanges;

an RF screen having a frame and a screen retained by the frame, the RF screen releasably attached to the reflector by a snap-fit connection between the frame of the RF screen and the pair of flanges of the reflector; and at least one snap-fit fastener assembly used to effect releasable attachment between the frame of the RF screen and one of the flanges of the reflector, and at least one snap-fit fastener used to effect releasable attachment between the frame of the RF screen and the other one of the flanges of the reflector, wherein a portion of one of the snap-fit fasteners used with each one of the flanges and a portion of one of the snap-fit fasteners used with the other one of the flanges are attached to the frame of the RF screen and complementary portions of the snap-fit fastener assembly are attached to the flanges.

12. The reflector and RF screen assembly of claim 11, wherein at least one of the snap-fit fasteners is a ball stud fastener having a ball stud located on the frame of the RF screen or one of the flanges of the reflector, and having a spring latch located on the other of the frame of the RF screen or one of the flanges of the reflector, the ball stud releasably engageable with the spring latch in order to effect the snap-fit connection.

13. The reflector and RF screen assembly of claim 11, further comprising:

a gasket disposed between the RF screen and the reflector;

wherein the snap-fit fasteners are a plurality of ball studs located on one side of the frame of the RF screen and a pair of ball studs located on the other side of the frame of the RF screen such that the screen of the RF screen is between each pair of ball studs, the ball studs extend through the gasket;

wherein a pair of spring latches are located on each of the flanges of the pair of flanges of the reflector; and wherein the ball studs are releasably engageable with the spring latches in order to effect the snap-fit connection.

14. The reflector and RF screen assembly of claim 11, wherein at least one of the snap-fit fasteners is a spring retainer having a spring clip located on the frame of the RF screen or one of the flanges of the reflector, and having a notch present in the other of the frame of the RF screen or one of the flanges of the reflector, the spring clip releasably engageable with the notch in order to effect the snap-fit connection.

15. The reflector and RF screen assembly of claim 11, further comprising:

a gasket disposed between the RF screen and the reflector;

wherein the snap-fit fastener includes a plurality of spring clips located on the frame of the RF screen on one side of the screen of the RF screen, and three spring clips located on the frame of the RF screen on the other side of the screen of the RF screen;

wherein the snap-fit fastener includes three notches present in one of the flanges of the reflector, and three notches present in the other flange of the reflector; and wherein the spring clips are releasably engageable with the notches in order to effect the snap-fit connection.

16. The reflector and RF screen assembly of claim 11, wherein the frame of the RF screen has at least one slot located thereon for aiding in the removal of the RF screen from the reflector.

17. The reflector and RF screen assembly of claim 11, further comprising a gasket located between the reflector and the RF screen, and wherein the gasket is selected from the group consisting of a metallic finger gasket, and a metallic fabric wrapped around an elastomer sponge core center gasket.

18. The reflector and RF screen assembly of claim 11, wherein at least one of the snap-fit fasteners is a finger gasket assembly having a metallic finger gasket located on the frame of the RF screen or one of the flanges of the reflector, and having a notch present in the other of the frame of the RF screen or one of the flanges of the reflector, the metallic finger gasket releasably engageable with the notch in order to effect the snap-fit connection, and the finger gasket assembly aiding in sealing a cavity defined by the reflector and the RF screen.

19. The reflector and RF screen assembly of claim 11, wherein one of the snap-fit fasteners is a magnetic fastener.

20. The reflector and RF screen assembly of claim 11, wherein one of the snap-fit fasteners is a quarter turn type fastener.

21. A reflector and RF screen assembly for a UV lamp system, comprising:

a reflector having a curved reflecting surface and a pair of flanges;

a spring latch located on one of the flanges of the reflector;

an RF screen having a frame and a fine mesh screen retained by the frame;

a ball stud located on the frame of the RF screen, wherein the ball stud is releasably engageable with the spring latch in order to releasably attach the RF screen to the reflector; and a metal fabric wrapped around an elastomer sponge core center gasket disposed between the frame of the RF screen and the pair of flanges of the reflector, the ball stud disposed through the gasket.

22. A reflector and RF screen assembly for a UV lamp system, comprising:

a reflector having a curved reflecting surface and a pair of flanges; and an RF screen having a frame and a screen retained by the frame, the RF screen releasably attached to the reflector by a snap-fit connection comprising at least one male connector and at least one female connector, wherein one of the male or female connectors is attached to the RF screen and the complementary male or female connector is attached to the reflector.

* * * * *